US006325691B1

(12) United States Patent
Witte, Jr.

(10) Patent No.: US 6,325,691 B1
(45) Date of Patent: Dec. 4, 2001

(54) PACKAGED TOY

(75) Inventor: Paul W. Witte, Jr., Maineville, OH (US)

(73) Assignee: Global Trade Network, Inc., Mason, OH (US)

( * ) Notice: Subject to any disclaimer, the term of this patent is extended or adjusted under 35 U.S.C. 154(b) by 0 days.

(21) Appl. No.: 09/531,972

(22) Filed: Mar. 20, 2000

(51) Int. Cl.[7] ..... A63H 33/00

(52) U.S. Cl. ..... 446/69; 446/73; 446/76; 446/491

(58) Field of Search ..... 446/69, 73, 76, 446/77, 117, 491

(56) References Cited

U.S. PATENT DOCUMENTS

| | | | | |
|---|---|---|---|---|
| 2,424,538 | | 7/1947 | Beder . | |
| 3,510,049 | | 5/1970 | Donovan . | |
| 3,647,132 | * | 3/1972 | Crabtree | 229/2.5 |
| 3,779,370 | | 12/1973 | Snow et al. . | |
| 3,787,599 | * | 1/1974 | Castanis . | |
| 4,553,691 | | 11/1985 | Morando . | |
| 5,064,398 | * | 11/1991 | Richardson | 446/75 |
| 5,344,023 | * | 9/1994 | Cox et al. | 206/508 |
| 5,405,148 | * | 4/1995 | Cianci | 273/273 |
| 5,538,136 | * | 7/1996 | Onneweer | 206/521.8 |

* cited by examiner

*Primary Examiner*—Jacob K. Ackun, Jr.
*Assistant Examiner*—Faye Francis
(74) *Attorney, Agent, or Firm*—Wood, Herron & Evans, LLP

(57) ABSTRACT

A packaged toy is provided in which toy egg sets of nested hollow toy eggs are held within a modular transparent egg carton. The modular transparent egg carton has a tray which holds the toy egg sets and a lid with a ceiling and a circumnavigating lip defining a depression in which the tray of a modular transparent egg carton is adapted to be located. A method of packaging a toy is provided in which plural toy egg sets are located within a modular transparent egg carton to form a matrix of packaged toys.

4 Claims, 1 Drawing Sheet

PACKAGED TOY

FIELD OF THE INVENTION

The present invention relates a packaged toy. More specifically, the present invention relates to packaging for toy eggs.

BACKGROUND OF THE INVENTION

Beliefs and myths coming down to us from antiquity have shown mankind's relationship with the egg to be a very profound one. This is well expressed in the Latin Proverb Omne Vivum Exovo, translated as "all life comes from an egg." Examples of this belief come from all around the world. In Europe it was believed that eggs laid on Good Friday, if kept for a hundred years, would have their yolks turned into diamonds.

Of course, one of the most well-known manifestations of beliefs surrounding the egg arises in the celebration of Easter. It has been speculated that missionaries or Knights of the Crusades were first responsible for bringing the coloring of eggs westward, a tradition that continues to this day.

Easter egg games popularized a few hundred years ago still delight children around the world. A favorite game has been rolling an Easter egg on a field, crashing them into each other until only one unbroken egg remains. Two of the best known locations for Easter egg games are Central Park in New York City and on the lawn of the White House on Easter Monday.

The original site of the Easter Monday Presidential egg roll was the grounds of the United States Capital during the administration of President Andrew Johnson. Although a small group of egg rollers were reported on the White House grounds under the presidency of General Ulysses S. Grant, the majority of egg rolling activity and Easter picnics took place at the capital. However, after Easter Monday activities took their toll on the capital grounds, Easter egg rolling was moved to the south lawn of the White House under the administration of President Rutherford B. Hayes. Successive presidents have continued the tradition, and the event has been held on the south lawn ever since.

From the mythology and tradition of imbuing the egg, all forms of fanciful eggs have been hatched. Probably the most famous decorative eggs in the world are the jeweled Faberge eggs which are considered priceless for their ornate design and craftsmanship.

While Faberge eggs may be highly desirable and sought after by collectors, eggs also occupy a nitch in the children's toy market. Plastic eggs which split into two halves can hold candy or toys which fit inside the assembled egg. So, toy eggs are not only popular during holiday seasons such as Easter, but are popular with children and, therefore, marketable in the toy industry year round. One type of toy egg is described in U.S. Pat. No. 2,424,538 in which a plurality of hollow eggs of increasing size and having a pair of body half sections fit inside each other with the outermost egg depicting the image of a fanciful figure such as a fairy tale character. Such toy eggs are now commonly sold in bags of loosely packaged products.

Chicken eggs are packaged in egg cartons of various sizes which accommodate different numbers of eggs, i.e., cartons with six, twelve, or eighteen pockets. Chicken egg cartons known in the art are made from a variety of materials, including cardboard and foamed polystyrene. U.S. Pat. No. 3,510,049 describes an egg carton with an entirely transparent rigid plastic top section and a foamed plastic bottom section.

OBJECTIVES OF THE INVENTION

It has been an objective of the present invention to provide an improved packaged toy egg product which is visually appealing to a consumer.

It has been another objective of the present invention to provide a packaged toy egg product which stacks easily and maximizes shelf space in a warehouse or retail store.

It has been a further objective of the present invention to provide a packaged toy egg product in which plural packages inner-lock to provide a more stable stacked product.

It has been an objective of the present invention to provide a packaged toy egg product which can be inexpensively shipped to a point of sale from the manufacturer.

It has been a further objective of the present invention to provide a packaged toy egg product with an added dimension to allow insertion and removal of the toy egg product from an egg carton.

It has been yet another objective of the present invention to provide a method of packaging toy eggs such that the packaged toy product is easily stackable and provides an appealing display in a store.

SUMMARY OF THE INVENTION

In accordance with the objectives of the present invention, a packaged toy is provided in which a plurality of hollow toy eggs of varying color and increasing size, e.g., small, medium and large, are nested within each other to form a toy egg set and are packaged within a modular transparent stackable egg carton.

The modular transparent egg carton has lid and a tray, the tray having a plurality of pockets in which the egg sets are located. The lid has a ceiling with a circumnavigating lip which defines a depression adapted to receive the tray of a second modular transparent carton to allow plural modular transparent cartons to be easily stacked together as a matrix of packaged toys.

A plurality of variously colored toy egg sets located within the modular transparent egg carton creates a visually exciting packaged toy product which is appealing to consumers when coupled with a strategically placed point of sale in a store.

Also in accordance with the principles of the present invention, a method of packaging a toy is provided in which first, second and third variously colored hollow toy eggs of increasing size are nested, one within another to form a toy egg set, and the nested toy egg sets are located within the transparent egg carton. Plural modular transparent egg cartons may be stacked, one on top another, so that the tray of a first modular transparent egg carton fits snugly against the lip and on the ceiling of a second modular transparent egg carton, thus, providing a matrix of packaged toys.

Thus, a packaged toy product is provided which provides an improved aesthetically appealing presentation at a point of sale and a method for packaging variously colored toy eggs in a modular transparent egg carton.

The above and other objects and advantages of the present invention shall be made apparent from the accompanying drawings and the description thereof.

DETAILED DESCRIPTION OF THE PREFERRED EMBODIMENT

Figure 1:
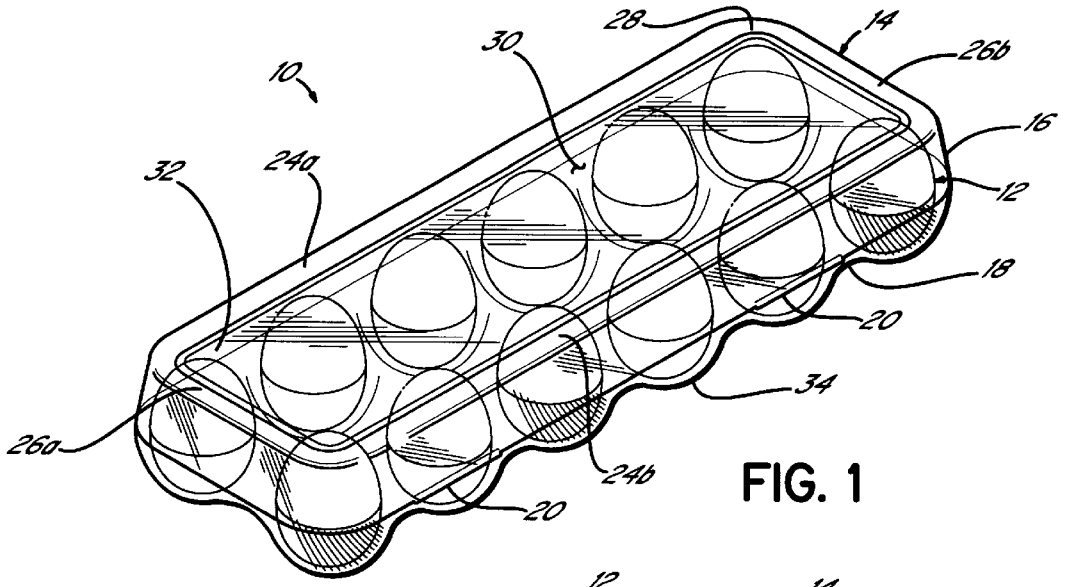
FIG. 1 is a perspective view of a packaged toy product in accordance with the principles of the present invention.
Figure 2:
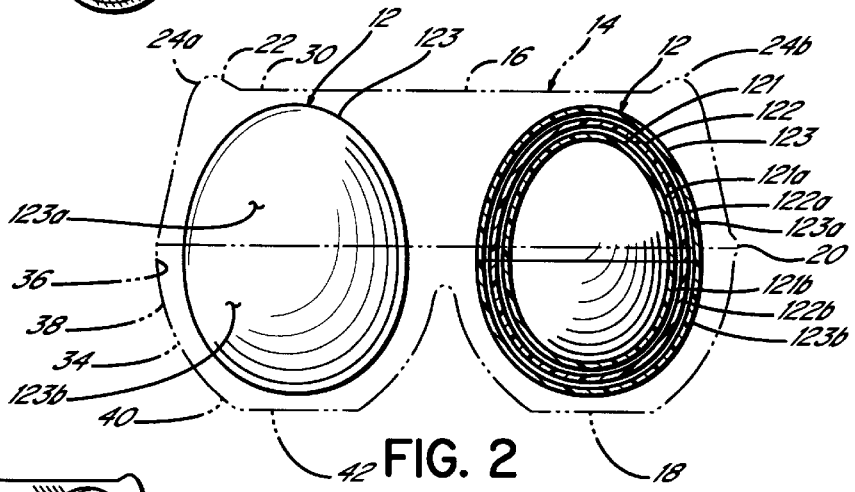
FIG. 2 is an end view of the packaged toy product of FIG. 1 with a partially cut-away view of toy egg sets held therein.

A packaged toy 10 in accordance with the principles of the present invention is seen in FIG. 1. The packaged toy product 10 includes a toy egg set 12 having first, second and third toy eggs 121, 122, 123 (FIG. 2). The first toy egg 121 is hollow and has a top half 121*a* and a bottom half 121*b* which connect together to form the first toy egg 121. The second toy egg 122 is hollow and has a top half 122*a* and a bottom 122*b* which connect together to form the second toy egg 122. The second toy egg 122 is larger than the first toy egg 121 and, thus, is adapted to receive or nest the first toy egg 121 therein. The toy egg set 12 has a third toy egg 123 which is hollow and has a top half 123*a* and a bottom half 123*b* that connect together to form the third toy egg 123. The third toy egg 123 is larger than the second toy egg 122 and is adapted to receive or nest the second toy egg 122 therein.

Figure 3:
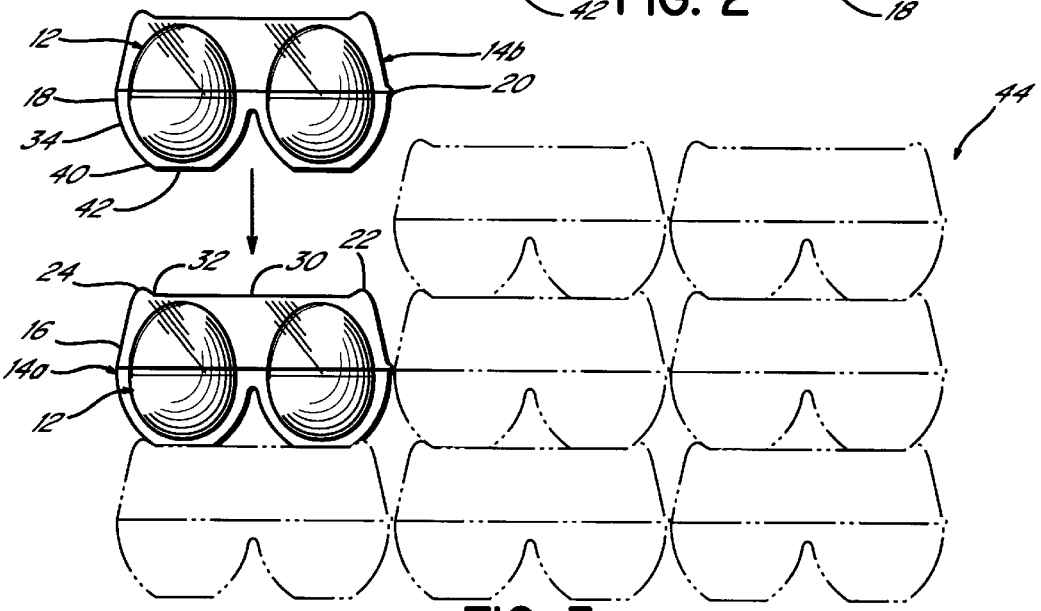
FIG. 3 shows plural packaged toy products stacked as a matrix of packaged toys.

Plural toy egg sets 12 are captured within a modular transparent egg carton 14. The modular transparent egg carton 14 has a lid 16 and a tray 18 preferably integrally connected together with a living hinge 20. The lid 16 has a circumnavigating lip 22 with first and second opposed longitudinal portions 24*a*, 24*b* and a pair of transverse portions 26*a*, 26*b* which form corner structure 28. The lip 22 is integrally connected with a ceiling 30, the lip 22 and ceiling 30 defining a depression 32 which is sized so that a first modular transparent egg carton 14*a* may have a second modular transparent egg carton 14*b* located against the ceiling 30 of the second modular transparent egg carton 14*a* (FIG. 3).

Each pocket 34 of tray 18 has an inner surface 36 in which a toy egg set 12 is held, and an outer surface 38. The outer surface 38 has a plurality of first outer surface portions 40 and second outer surface portions 42 which are preferably received against the lip 22 and ceiling 30, respectively, when a first modular transparent egg carton 14*a* is stacked with a second modular transparent egg carton 14*b* to form a matrix 44 of packaged toy products 10.

Thus, the inventive packaged toy 10 provides an improved aesthetically appealing presentation at a point of sale. The inventive method of packaging the toy 10 and forming the matrix 44 of packaged toy products 10 provides a stable display by virtue of the tray 18 of a second modular transparent egg carton 14*b* fitting against the lip 22 and ceiling 30 of the lid 16 of the first modular transparent egg carton 14*a*.

Advantages of this packaging technique include (1) dense packaging, (2) is less expensive to ship which is particularly important if the product is made outside of the country where it is to be sold, (3) compact storage is in the home where it is used, and (4) children love to insert and remove toys from packages or boxes. The toy egg product adds an additional entertainment dimension to toy eggs for small children since the child may insert and remove the eggs from the packages as well as by inserting one egg into another, etc.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A method of packaging a toy, comprising the steps of:

providing a first modular transparent egg carton having a lid connected to a tray comprising a plurality of pockets, said lid having a ceiling with a circumnavigating lip defining a depression, wherein said depression is sized to receive a tray of a second modular transparent egg carton within said depression;

nesting a first toy egg within a second toy egg;

nesting said second toy egg within a third toy egg to form a toy egg set;

locating said toy egg set within one of the plurality of pockets; and repeating said nesting steps and said locating step until each of the plurality of pockets contains a toy egg set, wherein said toy egg sets are visible through said lid and said tray of said carton.

2. The method of claim 1, comprising the step of stacking said first modular transparent egg carton with said second modular transparent egg carton so that said tray of said second modular transparent egg carton is located against said lip and said ceiling of said first modular transparent egg carton.

3. A matrix of packaged toys, comprising:

a plurality of toy egg sets, each set comprising a plurality of individual toy eggs; and a plurality of modular transparent egg cartons, each having plural pockets, a lid and a tray, wherein one of said toy egg sets is contained in a respective one of said pockets such that each pocket is filled and, wherein each of said lids has a ceiling with a circumnavigating lip defining a depression, and wherein each of said trays is sized to be located against said lip and said ceiling of one of said plurality of cartons within said depression, and wherein a first of said modular transparent egg cartons is stacked with a second of said modular transparent egg cartons so that said tray of said first transparent egg carton is located within said depression of said second transparent egg carton, and wherein said plurality of toy egg sets are visible through said lids and said trays of said cartons.

4. A method of forming a matrix of packaged toys, comprising the steps of:

forming a plurality of toy egg sets, each by nesting together a plurality of individual toy eggs;

providing a first modular transparent egg carton having plural pockets in a tray, and a lid connected to said tray, wherein each of said pockets is adapted to contain one of said toy egg sets, and wherein said lid has a ceiling with a circumnavigating lip defining a depression adapted to receive a tray of another modular transparent egg carton;

locating said plurality of toy egg sets within said first modular transparent egg carton to form a first filled carton wherein said toy egg sets are visible through said lid and said tray of said transparent egg carton;

repeating the forming, providing and locating steps a desired number of times to form a plurality of additional filled cartons;

stacking one of said additional filled cartons on said first filled carton within said depression of said first modular transparent egg carton wherein the tray of said additional filled carton is received against said lip and said ceiling of said first modular transparent egg carton; and repeating the stacking step to align a desired number of said additional filled cartons with the tray of one placed within the depression of another.

* * * * *